US005560500A

United States Patent [19]

Wilcox

[11] Patent Number: 5,560,500

[45] Date of Patent: Oct. 1, 1996

[54] SCALE CAR RACE TRACK DISPLAY

[76] Inventor: Jay E. Wilcox, 899 Sing Sing Rd., Horseheads, N.Y. 14845

[21] Appl. No.: 446,057

[22] Filed: May 19, 1995

[51] Int. Cl.[6] ..... A47F 5/08

[52] U.S. Cl. ..... 211/88; 211/13; 211/126; 248/220.1

[58] Field of Search ..... 211/88, 90, 126, 211/13; 248/240.3, 220.1; 446/444, 228; D6/553, 567, 569, 571, 572, 573, 574

[56] References Cited

U.S. PATENT DOCUMENTS

| | | | |
|---|---|---|---|
| D. 264,906 | 6/1982 | Franklin . | |
| 548,273 | 10/1895 | House | 211/126 X |
| 674,663 | 5/1901 | Baran | 248/73 X |
| 897,076 | 8/1908 | Eustis | 211/90 X |
| 3,245,716 | 4/1966 | Danner | 248/299.1 |
| 3,567,038 | 3/1971 | Ammann | 211/88 |
| 3,706,105 | 12/1972 | Nicholas et al. | 211/88 X |
| 4,036,369 | 7/1977 | Eisenberg | 211/90 X |
| 4,096,658 | 6/1978 | Neuhierl . | |
| 4,160,570 | 7/1979 | Bridges | 211/88 X |
| 4,161,279 | 7/1979 | Halford . | |
| 4,802,595 | 2/1989 | Northington | 211/88 |
| 5,131,618 | 7/1992 | Chapin . | |
| 5,342,048 | 8/1994 | Jones et al. . | |
| 5,370,249 | 12/1994 | Harvey et al. | 211/90 X |

*Primary Examiner*—Korie Chan
*Attorney, Agent, or Firm*—Richard C. Litman

[57] ABSTRACT

A U-shaped track formed into a banked curve mounted on the walls in a corner of a room with brackets. A pair of banked curves may be interconnected. Non-curved straight-away tracks may interconnect corner-mounted curved tracks.

7 Claims, 2 Drawing Sheets

SCALE CAR RACE TRACK DISPLAY

BACKGROUND OF THE INVENTION

1. FIELD OF THE INVENTION

This invention relates to model cars. More specifically, the present invention relates to wall-mounted shelving adapted for displaying model cars.

2. DESCRIPTION OF THE PRIOR

Young and old alike savor the age old pastime of model making. Model makers' ever increasing zeal to more realistically render their subjects drives them to explore new building materials, tools and techniques. Model car enthusiasts experiment with paints and suspension devices that give the appearance of motion. Unfortunately, these enthusiasts efforts are muted by the static display methods available. A need exists for inventions that provide model car enthusiasts with dynamic display means.

Several types of scale car display apparatuses are described in the literature. For example, U.S. Design Pat. No. Des. 264,906, issued Jun. 15, 1982, to Ollie N. Franklin, shows a combined display and storage unit for a model train. The apparatus appears to be a pedestal having a horizontal surface. A scaled-down set of railroad tracks are mounted to the pedestal. A train may be situated on the track. A clear cover mounts on the pedestal and encloses the train and tracks.

U.S. Pat. No. 4,096,658, issued Jun. 27, 1978, to Hermann Neuhierl, describes a toy model vehicle track support system. The device includes at least one pylon to which a plurality of horizontal flat elements are mounted. Supporting means stretch from the top of the pylon to remotely located mounting points on each flat element, similar to a suspension bridge.

U.S. Pat. No. 4,161,279, issued Jul. 17, 1979, to Wayne R. Halford, describes a curved track section for toy vehicle. The apparatus includes sections of pre-formed track, each section having predetermined bank angles. The sections are interconnected and form a continuous track for self-propelled vehicles. The track sections are shown resting on a horizontal surface.

U.S. Pat. No. 5,131,618, issued Jul. 21, 1992, to Michael J. Chapin, describes an elevated Christmas tree rack. The device includes a plurality of model railroad track sections, each connected to a Christmas tree collar section thereby defining a module. A plurality of modules are connected to form a railroad track encircling above a collar maintaining a Christmas tree.

U.S. Pat. No. 5,342,048, issued Aug. 30, 1994, to Lawrence T. Jones et al., describes a wall-mounted slot car track with moving accessories. The device includes generally flat, wall-mounted vertical members with electrified track sections disposed thereon. Each track section has a slot therein. Self-propelled electric model vehicles have retention members that are retained within the slots. The model vehicles receive electrical impulses from the track and translate thereon accordingly.

Clearly, the above demonstrates a need for a scale car race track display having a race track-like appearance.

None of the above references, taken alone or in combination, are seen as teaching or suggesting the presently claimed scale car race track display.

SUMMARY OF THE INVENTION

The present invention overcomes the above limitations of the above inventions by providing a banked corner display surface. The invention includes a U-shaped track formed into a banked curve. The track mounts with brackets on the walls in a corner of a room. Two corner-mounted tracks may be interconnected. The invention also may include straightaway tracks for interconnecting corner-mounted tracks.

In consideration of the above, an object of the invention is to provide a scale car race track display having a banked display surface.

Another object of the invention is to provide a scale car race track display that mounts on the walls in a corner of a room.

A further object of the invention is to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features of the invention consistently throughout the attached drawings.

DETAILED DESCRIPTION OF THE PREFERRED EMBODIMENTS

Figure 1:
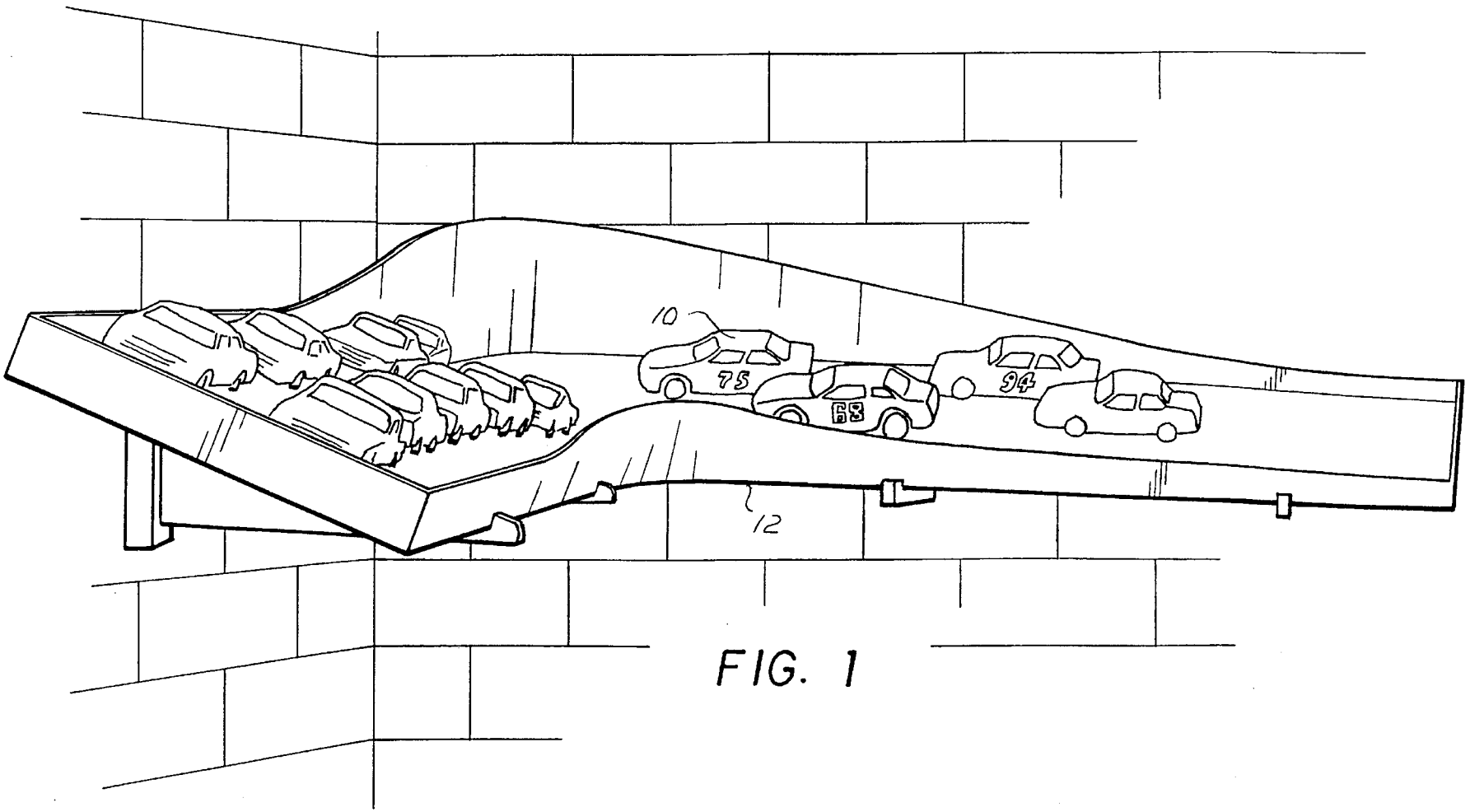
FIG. 1 is a top front environmental perspective view of the invention mounted to a wall.
Figure 2:
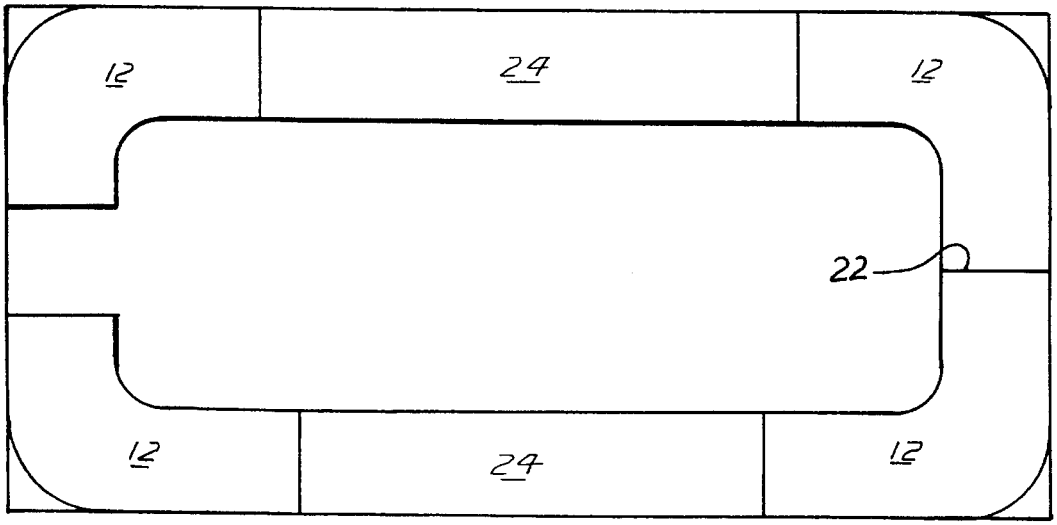
FIG. 2 is a top plan environmental perspective view of the invention mounted to a wall.

Referring to FIGS. 1 and 2, the invention is shown mounted on the walls in a corner of a room with a plurality of scale model vehicles 10 disposed thereon. The invention includes a U-shaped track 12. The track 12 may assume any shape suitable to the purposes of this invention. The track 12 is shown constructed of wood. However, the track may be manufactured from any rugged materials including, but not limited to: polyolefins, polystyrenes, copolymers containing the same; acrylonitrile/butadiene/styrenes copolymers, polyacrylates, polymethacrylates, phenolics or the like.

The track 12 is shown having been formed into a 25° banked curve around a 90° curve. This particular configuration has proven to be most suitable for displaying scale cars. Any degree bank angle around any degree curve suitable for the purposes of the present invention may be incorporated therein. The bank and curve appear like a race track. The vehicles 10 displayed on the track 12 appear as though involved in a race. Model vehicle enthusiasts may display their cherished models in a more dynamic fashion with the present invention.

Figure 3:
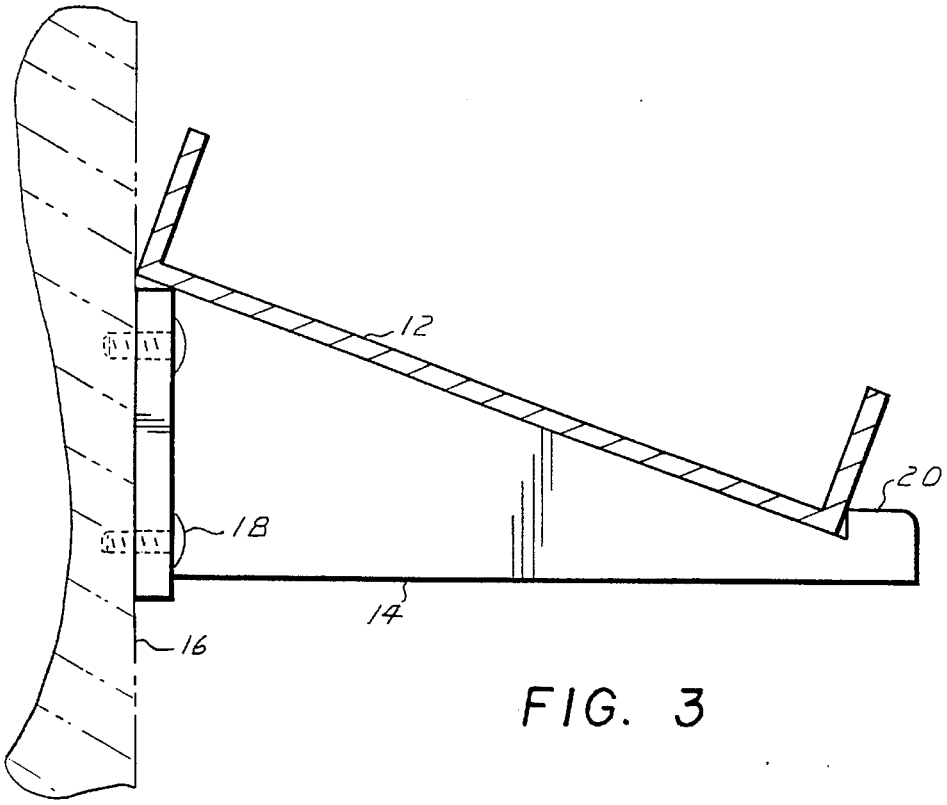
FIG. 3 is a side elevational view of a bracket drawn to an enlarged scale, showing the track in cross section, the view being taken across a straightaway track portion.

Referring to FIG. 3, one of a plurality of support brackets 14 is shown supporting the track 12. Each bracket 14 is mounted on a building wall 16. The bracket 14 is shown mounted with threaded fasteners 18. However, the mounting means may be effectuated by adhesive or with frictional fasteners, such as a nails, screws or "Molly" type bolts or the like.

The bracket 14 has a lip 20 for retaining the track 12. The track 12 and bracket 14 may have adhesive interposed therebetween or fasteners to obviate the need for the lip 20.

Referring again to FIG. 2, a number of curved tracks 12 are shown disposed in each corner of a room. The curved tracks 12 may be interconnected, as shown along line 22. The invention also may include any number of straightaway tracks 24 interposed between curved tracks 12. Interconnected tracks 12 and/or 24 may further enhance the race track-like appearance of the invention.

The present invention is not intended to be limited to the embodiments described above, but to encompass any and all embodiments within the scope of the following claims.

I claim:

1. A display apparatus for scale cars to be mounted on a wall having a corner, said display apparatus comprising:

at least one curved track having a first end, a second end, a bottom wall, a first wall, and a second wall, said first and second wall extending upward from said bottom wall, said first wall slopingly extending farther upward from said bottom wall than said second wall to provide the appearance of a realistic banked race track, said curved track being mountable to the corner of the wall;

first and second straight tracks each having a primary end, a secondary end, a bottom wall, a first wall, a second wall, and an end wall, each said secondary end being opposite each said primary end, each said first, second, and end walls of said first and second track extending upward from each said bottom wall, each said end wall connecting each said first and second wall of said first and second track at each said secondary end, said primary end of said first straight track being abutted against said first end of said curved track, said primary end of said second straight track being abutted against said second end of said curved track;

at least two brackets supporting each said straight and curved tracks, each said bracket being generally triangular in shape for mounting said straight and curved tracks at an angle to the wall.

2. A display apparatus as recited in claim 1, there being a plurality of each said straight and curved tracks, the dimensions thereof being determined such that multiple tracks may be positioned in end-to-end fashion to substantially fill the four walls of a room.

3. A display apparatus as recited in claim 1, wherein said angle is approximately 25 degrees.

4. A display apparatus as recited in claim 1, wherein each said first, second, and end walls of said first and second straight tracks extend equidistantly upward from each said bottom wall of said first and second straight tracks.

5. A display apparatus as recited in claim 1, wherein each said bracket has a generally vertical lip for retaining each said straight and curved tracks.

6. A display apparatus as recited in claim 5, wherein each said vertical lip makes contact with the second wall of each said straight and curved tracks.

7. A display apparatus as recited in claim 1 further including adhesive being placed on each said bracket where each said bracket makes contact with each said straight and curved tracks, whereby said adhesive fixes each said straight and curved tracks to each said bracket.

* * * * *